United States Patent [19]

Mair

[11] 4,145,796

[45] Mar. 27, 1979

[54] APPARATUS FOR FLATTENING THE BENT-UP EDGE OF A SHEET WORKPIECE

[75] Inventor: Franz Mair, Augsburg, Fed. Rep. of Germany

[73] Assignee: Erhard & Leimer KG, Augsburg, Fed. Rep. of Germany

[21] Appl. No.: 821,222

[22] Filed: Aug. 2, 1977

Related U.S. Application Data

[63] Continuation-in-part of Ser. No. 641,656, Dec. 17, 1975, Pat. No. 4,053,967.

[30] Foreign Application Priority Data

Dec. 18, 1974 [DE] Fed. Rep. of Germany ..... 2459682
Sep. 30, 1975 [DE] Fed. Rep. of Germany ..... 2543568

[51] Int. Cl.[2] ..... D06C 3/00

[52] U.S. Cl. ..... 26/98; 38/143; 226/97

[58] Field of Search ..... 26/DIG. 1, 98; 34/160, 34/225; 38/143; 226/7, 97, 200; 271/195

[56] References Cited

U.S. PATENT DOCUMENTS

| | | | |
|---|---|---|---|
| 2,613,521 | 10/1952 | Walmsley | 26/DIG. 1 |
| 2,613,522 | 10/1952 | Heffelfinger | 26/DIG. 1 |
| 2,747,250 | 5/1956 | Bramhall, Jr. et al. | 26/DIG. 1 |
| 3,142,107 | 7/1964 | Wittig | 26/DIG. 1 |
| 3,874,043 | 4/1975 | Holm | 26/DIG. 1 |

*Primary Examiner*—Robert W. Saifer
*Attorney, Agent, or Firm*—Karl F. Ross

[57] ABSTRACT

A sheet workpiece having an edge bent over on one face of the workpiece towards the center of the workpiece is continuously displaced in a transport direction over a flat support surface that lies against the other face of the workpiece at the bent-over edge. Compressed air is blown from a guide in a flow direction extending transverse to the transport direction, outwardly from the workpiece center, and generally parallel to the surface so as to blow this bent-over edge flat. A plurality of nozzles inclined slightly downwardly toward the surface and backwardly in the transport direction may be employed, as a single elongated nozzle producing a band-shaped current of air may be used, or a plurality of nozzles spread out in a two-dimensional array. Such a flow of air may also be directed from both faces at the workpiece edge in order to flatten out this edge no matter which way it is bent over. When a plurality of nozzles are employed each nozzle may be formed as a plug secured in a support plate having an inclined outlet passage and rotatable in order to vary the flow direction.

5 Claims, 26 Drawing Figures

FIG. 8
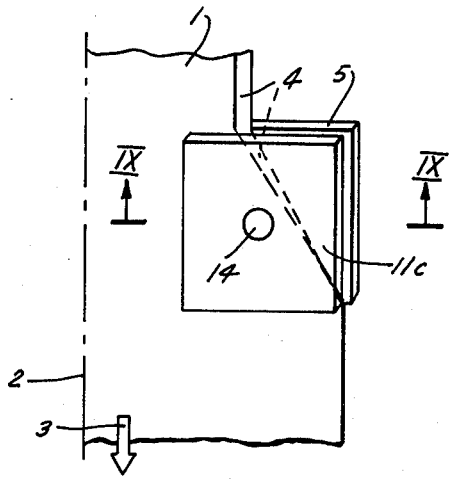
FIG. 9
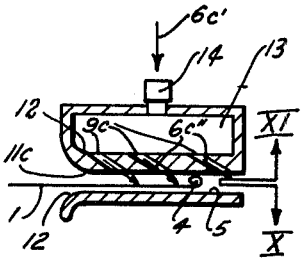
FIG. 10
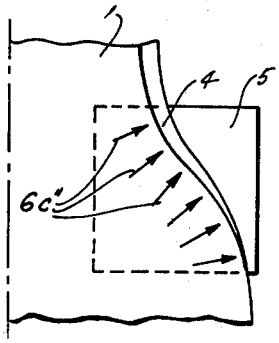
FIG. 11
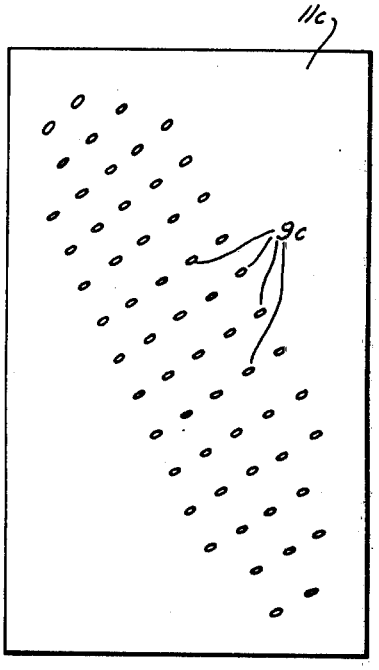
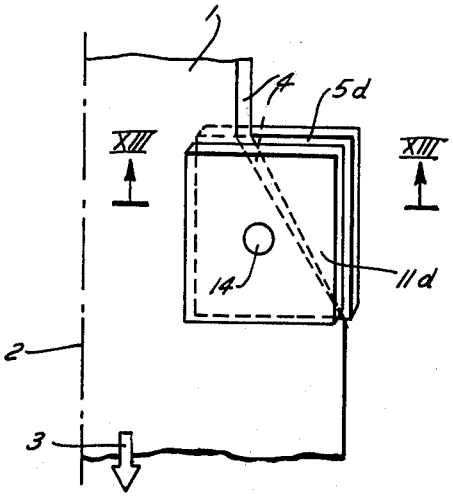
FIG. 12
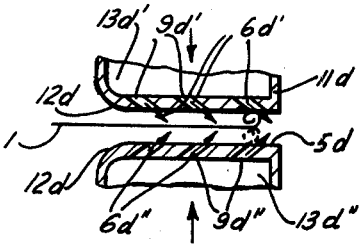
FIG. 13

FIG. 14
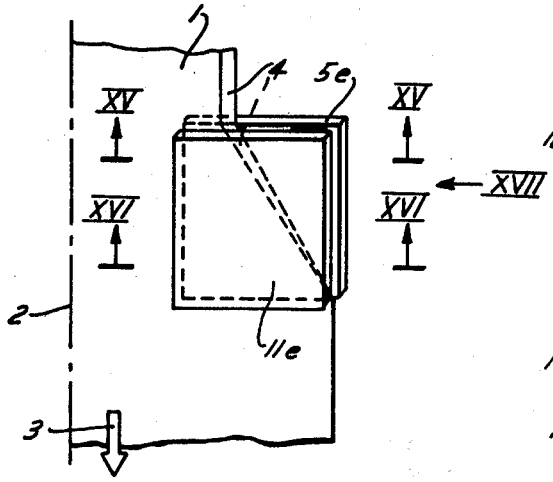
FIG. 15
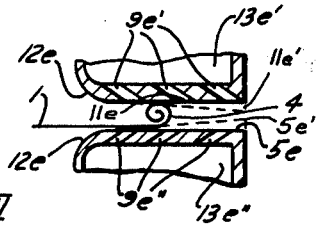
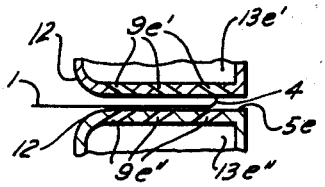
FIG. 16
FIG. 17
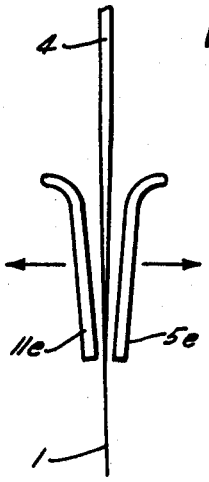
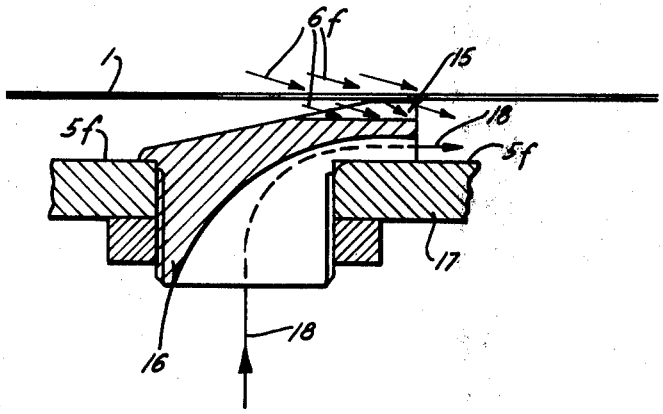
FIG. 18

APPARATUS FOR FLATTENING THE BENT-UP EDGE OF A SHEET WORKPIECE

CROSS REFERENCE TO RELATED APPLICATION

This application is a continuation-in-part of Ser. No. 641,656 filed 17 Dec. 1975, now U.S. Pat. No. 4,053,967.

FIELD OF THE INVENTION

The present invention relates to an apparatus for flattening a flexible sheet-type workpiece. More particularly this invention concerns the flattening of a bent-over or rolled-up edge of an elongated band workpiece continuously passing a treatment location.

BACKGROUND OF THE INVENTION

A multitude of manufacturing processes use band-type workpieces, such as textile weaves or knits, synthetic-resin foils, paper, and the like. Frequently at least one longitudinal edge of such a workpiece rolls up or bends over, necessitating flattening out of the workpiece before it can be employed in the manufacturing process. In many processes where the workpiece is advanced longitudinally at high speed the nature of the transport for such a workpiece inherently causes the longitudinal edges to curl up. Furthermore the type of workpiece itself usually causes the bending over or rolling up to take place at one face of the workpiece rather than the other.

It has been suggested, as in German published specifications Nos. 1,460,650 and 2,218,916 as well as in German Pat. Nos. 250,987 and 462,889, to flatten these bent-over edges out by means of rods, disks or wheels, or by means of smoothing bands running transverse to the direction of transport of the workpiece having the bent-over edge. All such systems rely on the flattening tool physically engaging the workpiece and smoothing out the bent-over edge.

The principal disadvantage of this arrangement is that the flattening tool can damage the workpiece. This is especially the case for thin synthetic-resin foils.

Another disadvantage of these known flattening systems is that they are not readily adapted to fit into other manufacturing processes. Very often the goods must be slowed down considerably at the flattening location so that the entire process must be similarly slowed down in order to allow for the flattening procedure to be effective. Furthermore most known flattening arrangements cannot tolerate any variation in speed of the goods, as the lateral rolling-out must take place at a rate directly proportional to the displacement rate. Any slowing down or speeding up can cause the goods to be damaged or shifted sideways. Another disadvantage of the known systems is that the band whose edges are being flattened out must almost invariably be spanned relatively tightly longitudinally in a manner that is not necessarily acceptable for many types of workpieces.

OBJECTS OF THE INVENTION

It is therefore an object of the present invention to provide an improved apparatus for flattening a sheet workpiece.

Another object is the provision of a system for unrolling or unbending the bent-over or rolled-up edge of a workpiece without marring or damaging the workpiece at all.

Yet another object is the provision of such an arrangement which is effective over a wide range of workpiece transport speeds and which is not damaging to the workpiece even if it should be stopped.

SUMMARY OF THE INVENTION

These objects are attained according to the present invention in a system wherein the edge of the sheet workpiece is flattened by passing an air current over the edge of the workpiece in a flow direction extending transverse to the transport direction of the workpiece, outwardly from the center of the workpiece, and generally parallel to a support surface lying against the face of the workpiece opposite that face on which the edge is bent over or rolled up. Thus in accordance with the present invention this face of the workpiece is juxtaposed with the flat support face and the surface and the workpiece are relatively displaced in a transport direction generally parallel to the bent-over edge. The current of air is passed over the workpiece in the above-described flow direction so as to blow the bent-over edge flat against the support surface.

The term "bent-over" is here used to include folded over (creased), rolled over (uncreased) or like deviation from absolute planarity. The "flattening" operation here performed is a straightening or extending of the band or web to eliminate the "bent-over" portion.

According to a further feature of this invention the gas stream, which may simply be compressed air or steam if desired, is generally band-shaped with the width of the band lying parallel to the support surface. This band shape can be formed by means of an elongated slot-type nozzle or a row of nozzles all directed in the flow direction and spaced apart along a line parallel to the surface.

According to another feature of this invention the flow direction is inclined somewhat backwardly from the center against the direction of travel of the workpiece, and is inclined slightly toward the support surface. This insures that the bent-over edge, by which is also meant a rolled-up or crumpled edge, is surely blown all the way out flat and maintained flat. With such a flow direction and a band-shaped current of air it is possible exactly to unroll a workpiece, with the unrolling edge lying directly in line with the row of nozzles or the slot producing the current of gas.

In accordance with another feature of this invention a plurality of nozzles all pointed in the flow direction are spaced about in a two-dimensional array over the support surface so that the unrolling or flattening device can be used with various different types of workpieces. With such an arrangement a newly loaded-in workpiece will be unrolled right from its leading edge.

In accordance with yet another feature of the present invention a guide surface is provided spaced from the support surface and defining therewith a slot or gap through which the workpiece is pulled. The nozzle or nozzles for creating the current of air are provided in either or both of the surfaces and the two surfaces may approach one another outwardly from the center of the workpiece. This type of arrangement insures that the workpiece will be flattened out no matter which face it is rolled up on, and once flattened out it will be unable to roll up again. The two plates forming these surfaces may also approach one another in the transport direction.

It is also possible in accordance with the present invention to form the current of air by jet-pump action, that is according to the Bernoulli principle by blowing a jet of air past the edge of the workpiece in a direction parallel to the flow direction but over the face of the workpiece opposite that face over which the edge is bent up, so as to entrain a current of air in the flow direction over the face on which the edge is bent up or rolled over. Thus the current of air is entrained by the jet of air on the opposite side of the workpiece, or can even be created by vacuum effect, with the current of air coming in through an appropriate guide in the flow direction.

When the current of air is produced by one or more nozzles it is possible in accordance with this invention to form these nozzles directly in the support surface or the guide surface overlying the support surface. Each such nozzle in accordance with this invention is constituted as a plug recessed in the appropriate surface and having a passage extending in the flow direction and connectable to a source of compressed air or the like. Each such plug is rotatable about a respective axis perpendicular to the plane of the respective surface so that the flow direction can be exactly set. Thus each such plug is received in a throughgoing hole in a plate constituting the surface and has on its face corresponding to the support surface a laterally extending lip received in a recess or counter bore, and on its side opposite the support surface with a nut that allows the plug to be clamped tightly in place. Means may also be provided in accordance with this invention linking together a plurality of such plugs so as to allow their orientation directions to be changed jointly. With such an arrangement the plate constituting the respective surface is advantageously formed as one wall of a closed chamber to which air under pressure is supplied.

Such an arrangement allows a group of plugs having differently inclined nozzle passages to be mounted on the plate and thereby achieve very precisely determinable aerodynamic effects. When the nozzles are spread out in two-dimensional array over the support plate or guide plate it is possible to aim some of the nozzles in a direction virtually parallel to the respective plate and others at a much greater angle so as to unroll a tightly crimped or rolled up edge or a loosely rolled up edge effectively. Some of the nozzles may be fed air at greater pressure than others to further vary this effect. Furthermore some nozzles having a small flow cross-section may be used at locations in order to achieve a carefully balanced flattening out of the workpiece. When such nozzle plugs are connected to the input side of a blower or compressor, they create the above-described current of air by suction and are very effective to vacuum-pull the workpiece down onto the surface.

With the system according to the invention no tools need touch the edge of the workpiece that is being flattened out. Only a current of air which is highly effective to flatten out the edge but hardly capable of damaging the workpiece need touch it. Furthermore, a workpiece which is topped underneath the arrangement is not likely to be torn as it will merely be blown flat and held so until the transport starts up again. Since it is possible to vary the flow characteristics of the current of air that flattens the edge it is also possible exactly to determine just where and at what rate the rolled-up or bent-over edge will be flattened.

The arrangement in accordance with this invention can readily be fitted into any manufacturing process, as it takes up very little room and does not require any longitudinal or transverse tensioning of the workpiece. Holes or other irregularities in the workpiece have virtually no effect on the functioning of the device and loading of the workpiece into the arrangement is a very simple manner. The system in accordance with this invention can be employed with workpieces moving at high speed or slow speed, and workpieces subjected to considerable longitudinal tension or relatively no longitudinal tension. The functioning of the apparatus has virtually no effect on any tensioning in the workpiece so as not to interfere with downstream processing operations.

BRIEF DESCRIPTION OF THE DRAWING

FIG. 8 is a top view of another edge flattener according to the present invention;

FIG. 9 is a section taken along line IX—IX of FIG. 8;

FIGS. 10 and 11 are views taken in the direction of arrows X and XI, respectively, of the arrangement of FIG. 9;

FIG. 12 is a top view of an arrangement in accordance with the present invention;

FIG. 13 is a section taken along line XIII—XIII of FIG. 12;

FIG. 14 is a top view of another arrangement in accordance with this invention;

FIGS. 15 and 16 are sections taken along lines XV—XV and XVI—XVI, respectively, of FIG. 14;

FIG. 17 is a view taken in the direction of arrow XVII of FIG. 14;

FIGS. 18–21 are large-scale sections through nozzles in accordance with this invention;

SPECIFIC DESCRIPTION

Figure 1:
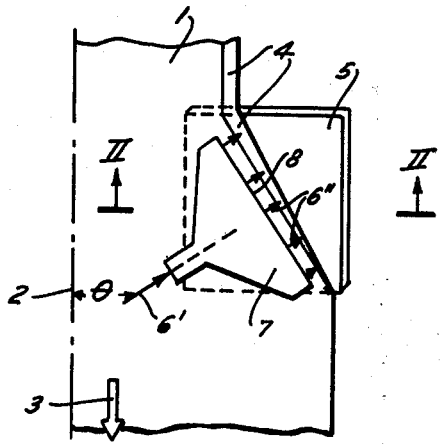
FIG. 1 is a top view of an apparatus according to this invention.
Figure 2:
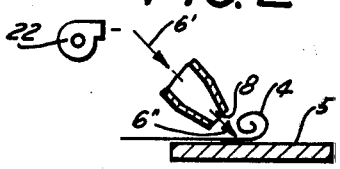
FIG. 2 is a section taken along line II—II of FIG. 1.

As shown in FIGS. 1 and 2 a workpiece 1, half of which is shown, has a centerline 2 and is displaced in a direction 3 parallel to this centerline 2. This workpiece 1, which may be a strip of woven or knitted material, a synthetic-resin sheet or foil, a paper band, or any similarly flexible strip material, has a rolled-up edge 4 extending up above one face of the workpiece 1. The workpiece 1 is passed longitudinally in the direction indicated by arrow 3 over a plate constituting a planar support surface.

A nozzle 7 receives air from a blower 22 as shown at 6' and has an elongated outlet opening or slot 8 extending parallel to the surface 5 and directing a band-shaped current of air as indicated at 6'' against the rolled-up edge 4. This current 6″ is directed at an angle θ of between 50° and 60°, here 55°, to the centerline 2 and is inclined somewhat downwardly with respect to the surface 5. Thus as best seen in FIG. 1 the rolled-up edge 4 is blown out flat so that the workpiece 1 can be further utilized.

Figure 3:
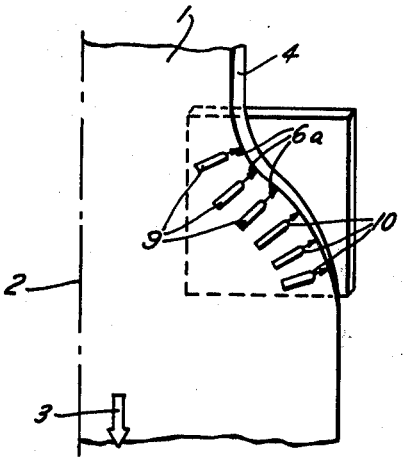
FIGS. 3 and 4 are top views of further systems in accordance with this invention.

It is possible as shown in FIG. 3 to replace the nozzle 7 with a plurality of nozzles 9 having outlet openings 10 directed so as to produce currents 6*a* that are all directed outwardly from the centerline 2, transverse to the centerline, and generally parallel to the surface 5. The openings 10 of these nozzles 9 lie along a nonstraight pass so that the rolled-up edge 4 will unroll along a nonstraight line also.

Figure 5:
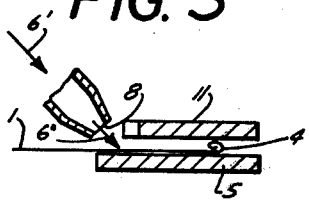
FIG. 5 is a section taken along line V—V of FIG. 4.
Figure 4:
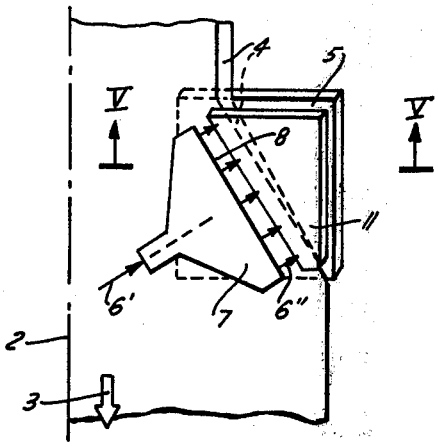

FIGS. 4 and 5 show an arrangement identical to that of FIG. 1, but wherein a plate 11 parallel to and above the plate 5 acts to confine the currents 6′ and thereby increase the flattening-out effect thereof.

Figure 6:
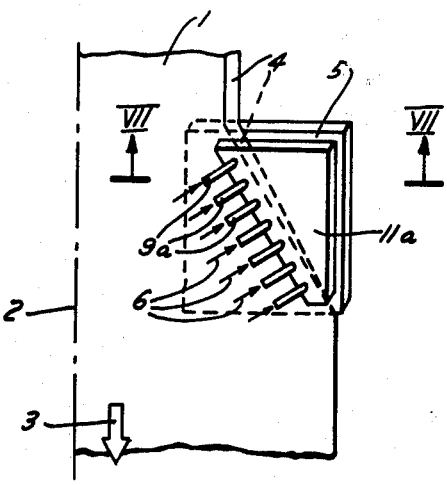
FIG. 6 is a top view of yet another arrangement in accordance with the present invention.
Figure 7:
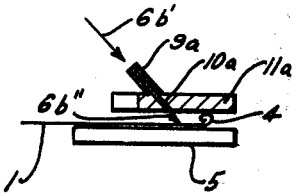
FIG. 7 is a section taken along line VII—VII of FIG. 6.

FIGS. 6 and 7 show a plurality of nozzles 9*a* functionally identical to the nozzles 9 and having outlet openings 10*a* which can be fitted into a plate 11*a* identical to the plate 11 so as to take in air as shown in 6*b*′ and expel it as shown at 6*b*″ in the above-described flow direction. In this arrangement the nozzles 9*a* have their openings 10*a* all in a straight line lying at the above-described angle θ to the centerline 2.

FIGS. 8, 9, 10 and 11 show an arrangement wherein a hollow upper plate 11*c* having a rounded inside edge 12 and defining an interior chamber 13 receives air under pressure as shown at 6*c*′ through an inlet nipple 14 and expels it through nozzle holes 9*c* to produce currents 6*c*″ which are spaced about in a two-dimensional array as shown in FIG. 11 and flow in the directions indicated in FIG. 10. Such an arrangement insures that different workpieces of different flexibilities will be unrolled. The arrangement of FIGS. 12 and 13 shows a pair of plates 11*d* and 5*d* forming respective chambers 13*d*′ and 13*d*″ from which air is expelled through nozzle openings 9*d*′ and 9*d*″ in flow directions indicated by arrows 6*d*′ and 6*d*″. The edges of the plates 5*d* and 11*d* are rounded as shown at 12*d* toward the center line 2 of the workpiece 1.

FIGS. 14, 15, 16 and 17 show an arrangement identical to that of FIGS. 12 and 13, with reference numbers referring to like structure carrying the superscript *e*, but wherein the two plates 11*e* and 5*e* are inclined toward one another in the transport direction. Thus the gap between these two plates 5*e* and 11*e* decreases in the direction 3 in order to ensure that the flattened workpiece remains flat and that the blowing flattening effect is optimized. Even if the rolled-up edge 4 is of the smallest possible diameter, it will be effectively blown flat. This funnel shape of plates 11*e* and 5*e* makes the apparatus self-feeding. It is also possible to incline plates 11*e* and 5*e* toward each other from the center 2 out as shown by dot-dash lines 11*e*′ and 5*e*′.

Instead of directly blowing a stream of air over the workpiece 1 it is possible as shown in FIG. 18 to provide nozzles 16 in the substrate surface 5*f* which direct the current of air indicated at 18 parallel to the surface 5*f* and entrain a current of air as indicated at 6*f* by the Bernoulli principle. To this end the nozzles 16 are each formed at their top with a notch 15 constituting a sucking groove and defining the flow direction. This nozzle is rotatable in the plate 17 constituting the substrate of surface 5*f*.

Figure 19:
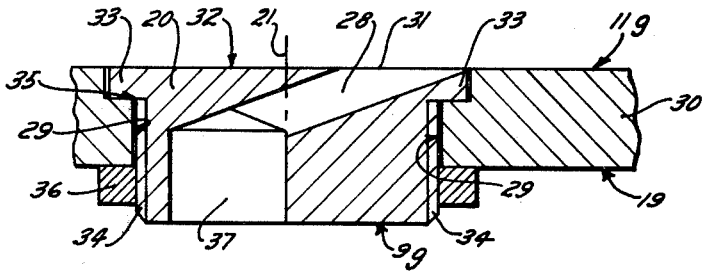

The nozzle shown in FIG. 19 at 9, basically comprises a plug 32 secured in a plate 30 having an upper surface 11*g* and a lower surface 19. This plug 32 has an upper portion 20 formed with a lip 33 lying on a counterbore shoulder 35 of plate 30 and having an upper surface 31. The nozzle passage 28 opening onto an axially open hole 37 forms a passage through the plug 32. This plug 32 is rotatable within the hole 29 formed through the plate 30 about a central axis 21 and has a thread 34 over which is screwed a nut 36 that can lock it in place. Thus this plug 32 constitutes a nozzle 9*g*.

Figure 20:
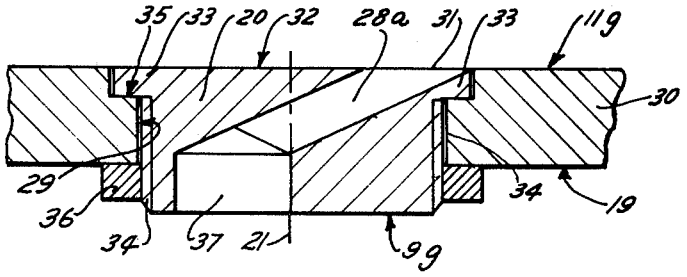
Figure 21:
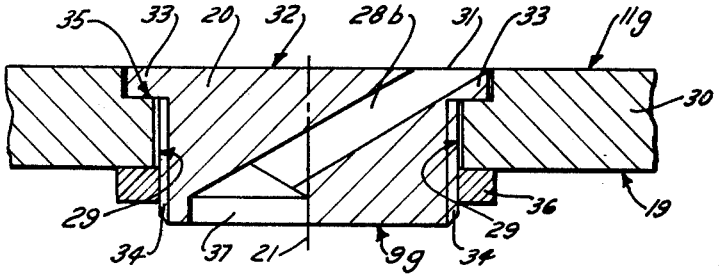

The plugs shown in FIGS. 20 and 21 are identical to those shown in FIG. 19, but with different angles of inclination between the passages 28*a* of the plug of FIG. 20 and 28*b* of the plug of FIG. 21. The passage 28 of the plug of FIG. 19 is inclined at an angle of 70° to the axis 21, the passage 28*a* at an angle of 65° and the passage 28*b* at an angle of 60°.

Figure 22:
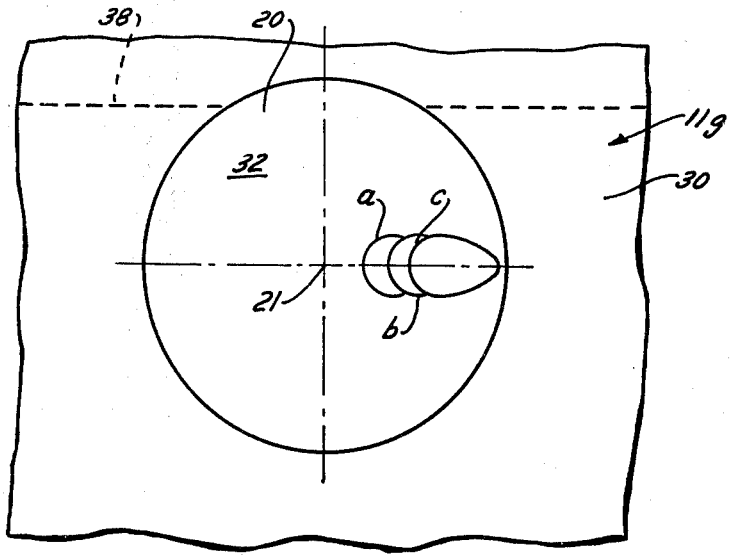
FIG. 22 is a top view of the nozzle of FIG. 21.

These passages therefore open up the surface as shown in FIG. 22 as *a, b, c* for the passages 28, 28*a* and 28*b*, respectively.

The plugs 32, which may form an array as shown in FIG. 11, need not be locked tight in the holes 29, but can be left slightly loose and rotatable about their axes 21. To this end an adjustment element such as a string as indicated at 38 in FIG. 22 may be wrapped around the inside ends of all of the plugs 32 so that displacement of this string causes all of the plugs to rotate in the same direction, thereby changing the flow direction of the air issuing from the passage of the respective plug. It is also possible to connect them to separate sources of air under pressure so that different blowing effects can be achieved over the array of nozzle openings.

Figure 24:
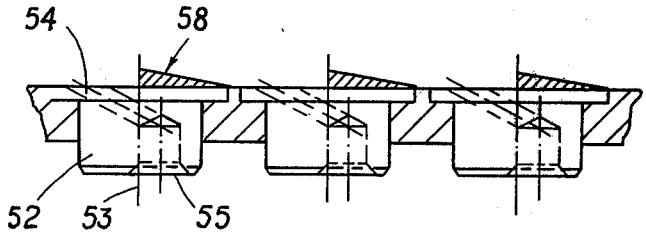
FIG. 24 is a cross-sectional view taken generally along the line XXIV—XXIV of FIG. 23.
Figure 23:
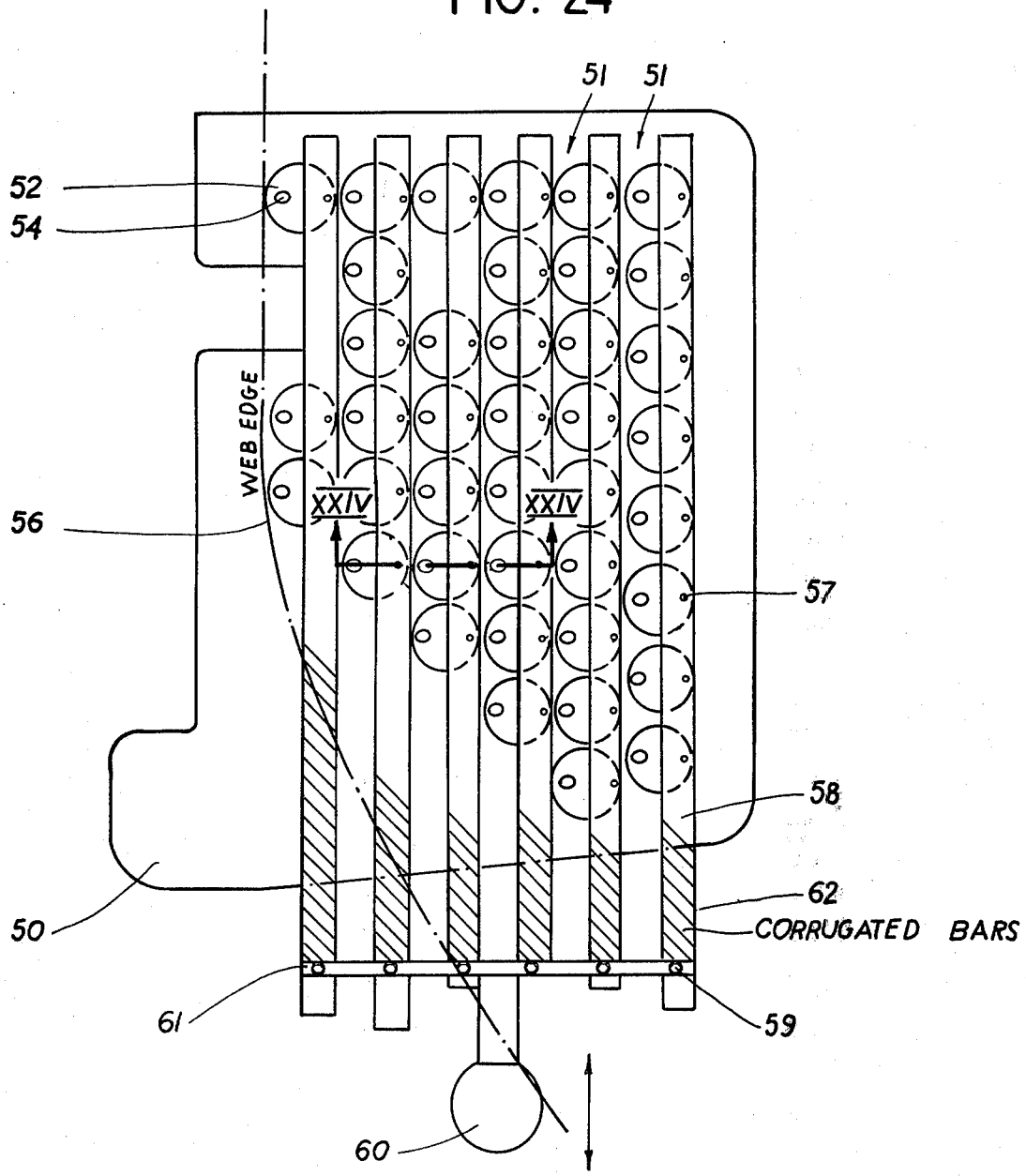
FIG. 23 is a view similar to FIG. 11 but illustrating an arrangement for angularly adjusting all of the nozzles of an array in accordance with the invention.

In FIGS. 23 and 24, I have shown an arrangement for controlling the angular positions of plugs of the type illustrated, for example, in FIGS. 19–22, i.e. for the joint displacement of these plugs.

The surface 50 is here shown to be provided with an array of mutually parallel rows 51 of plugs 52, the rows being spaced apart and the plugs being, in turn, spaced apart along each of these rows.

Each of the plugs 52 is angularly displaceable about a respective axis 53 and is formed with an upwardly directed passage 54 communicating via a bore 55 with a plenum chamber which is charged with compressed air as has been described in connection with FIGS. 19–22. The outline of the edge of the web to be unrolled has been shown in dot-dash lines in FIG. 23.

Each of the plugs 52 has, diametrically opposite its outlet 54, a hollow rivet 57 or the like which can be engaged to enable the angular displacement of each such plug for control of the air outflow direction for maximum efficiency in the unrolling of the edge.

Each row 51 of nozzle plugs is associated with a common bar 58 engaging the rivets of the nozzle plugs rotatably. The bars 58 are connected together by a transverse bar 59 upon which an actuating handle 60 is affixed. The actuating handle can be manually operated or can be displaced by a torque-generating magnet, a fluid-pressure cylinder or the like. Individual bars can be adjusted with respect to the connecting bar 59 by the loosening of set screws 61 which permit each bar 58 to slide with respect to the bar 59 in a groove thereof.

The bars 58 have cross sections as shown in FIG. 24 such that they do not deflect the strips or jets of air emerging from the nozzles of the adjacent row. The bars can thus lie flush with the surface 50 or, if they overlie the surface 50 as shown in FIGS. 23 and 24, can have an inclination upwardly of the same direction as the passages 54 but preferably to a lesser extent. The bars may also be corrugated as represented at 62 and have been found to be highly effective in preventing adhesion of the web of foil to the nozzle carrier. Naturally, the structure illustrated in FIGS. 23 and 24 can be inverted so that the bars 58 lie within the plenum chamber.

Figure 26:
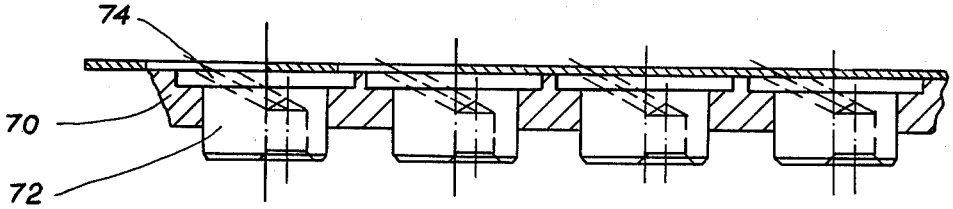
FIG. 26 is a view similar to FIG. 24 but corresponding to the embodiment of FIG. 25.
Figure 25:
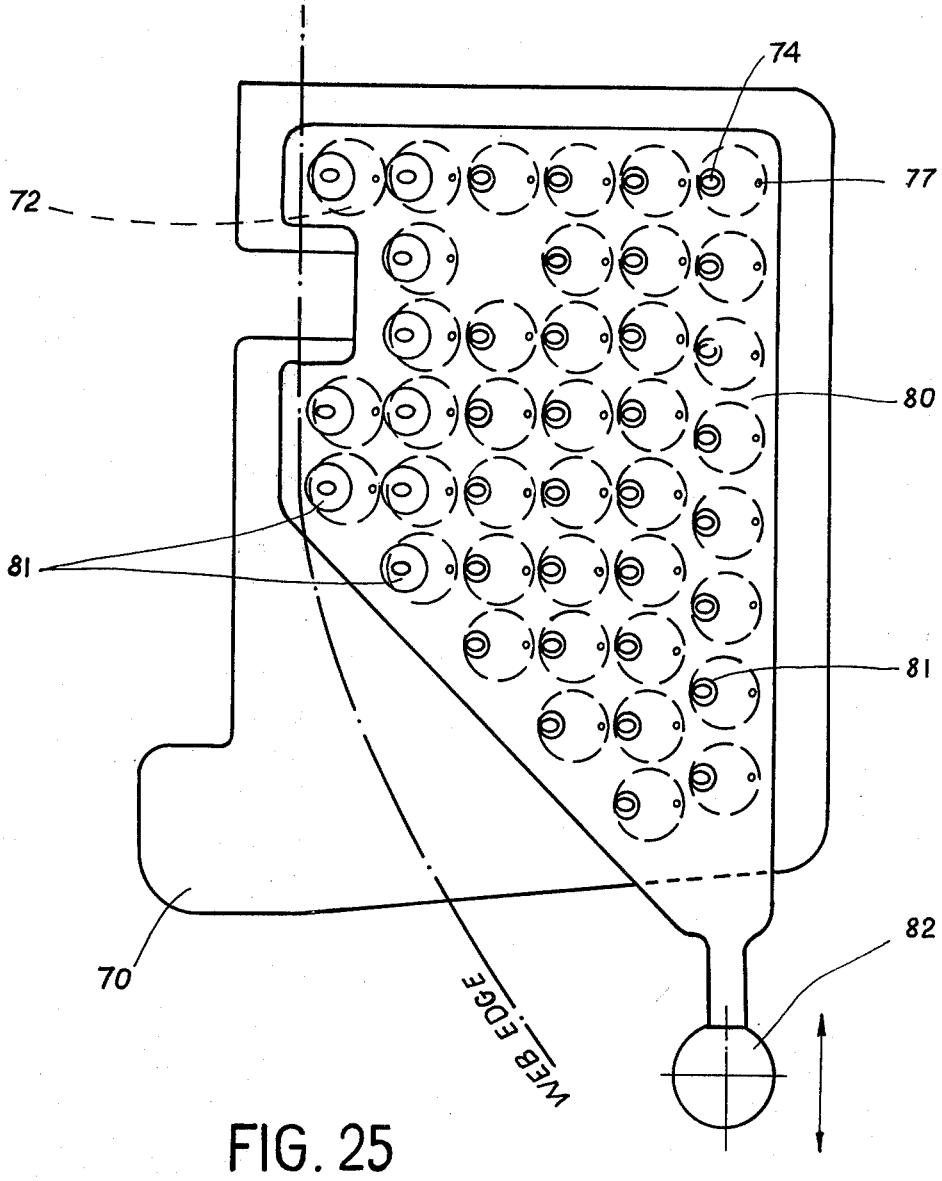
FIG. 25 is a view similar to FIG. 23 but illustrating another embodiment of the invention.

FIGS. 25 and 26 illustrate another embodiment of the invention which, however, functions in a manner analogous to that of FIGS. 23 and 24. In this embodiment, however, the plate 70 formed with the plugs 72 above a plenum chamber, is overlain by a thin sheet 80 having approximately the outline of the array of nozzle plugs. The sheet 80 is formed with openings 81 larger than the nozzle passages 74 of the plugs so as to permit a rotation of the plug relative to the sheet 80 which engages the plugs through rivets or pins 77 diametrically opposite the outlets 74. A handle 82 is provided as described to enable the sheet 80 to be displaced and thereby angularly shift all of the plugs in common.

With the embodiment of FIG. 25, the extreme position of the sheet 80 can cause the plugs to swing so that their nozzles 74 lie beneath the sheet, thereby blocking some or all of the nozzles and controlling the number of jets which are effective. The sheet can be composed of nickel or aluminum alloy and can have a thickness of, say, 1 mm.

It has been found to be advantageous to provide the openings 81 of the nozzles of the first two rows substantially larger than the other openings so that these nozzles remain effective even in the extreme positions of the sheet 80.

The units illustrated in FIGS. 25 and 26 can be provided in pairs, as has been described, under the control of a sensor for solenoid actuation with either the left or the right unit being rendered effective for control and guidance of the web.

I claim:

1. An apparatus for flattening a sheet workpiece having an edge bent over on one face of said workpiece toward the center thereof and being continuously displaced in a transport direction generally parallel to the bent-over edge, said apparatus comprising:

a flat support surface lying against the other face of said workpiece at said bent-over edge;

a guide surface juxtaposed with and generally parallel to said support surface and spaced therefrom to overlie said one face of said workpiece;

a two-dimensional array of orifices each formed in a respective nozzle in one of said surfaces, said orifices being inclined in a flow direction extending transversely to said transport direction outwardly from said center, said orifices directing respective jets of air against said workpiece for unfolding said bent-over edge;

means for supplying air under pressure to said array of nozzles; and means connected with said nozzle for altering said flow direction, said means connected to said nozzle including at least one member connected in common to some of the nozzles of said array, said nozzles being disposed in rows and said member including respective bars each linked to the nozzles of a respective row and actuating means connected to all of said bars for jointly displacing same.

2. An apparatus for flattening a sheet workpiece having an edge bent over on one face of said workpiece toward the center thereof and being continuously displaced in a transport direction generally parallel to the bent-over edge, said apparatus comprising:

a flat support surface lying against the other face of said workpiece at said bent-over edge;

a guide surface juxtaposed with and generally parallel to said support surface and spaced therefrom to overlie said one face of said workpiece;

a two-dimensional array of orifices each formed in a respective nozzle in one of said surfaces, said orifices being inclined in a flow direction extending transversely to said transport direction outwardly from said center, said orifices directing respective jets of air against said workpiece for unfolding said bent-over edge;

means for supplying air under pressure to said array of nozzles; and means connected with said nozzle for altering said flow direction, said means connected to said nozzle including at least one member connected in common to some of the nozzles of said array, said member being a sheet linked to said nozzles, said sheet being formed with openings adapted to register with the orifices of said nozzles in the last one position of said sheet, said sheet having a further position blocking at least some of said orifices.

3. An apparatus for flattening a sheet workpiece having an edge bent over on one face of said workpiece toward the center thereof and being continuously displaced in a transport direction generally parallel to the bent-over edge, said apparatus comprising:

a flat support surface lying against the other face of said workpiece at said bent-over edge;

a guide surface juxtaposed with and generally parallel to said support surface and spaced therefrom to overlie said one face of said workpiece;

a two-dimensional array of orifices each formed in a respective nozzle in one of said surfaces, said orifices being inclined in a flow direction extending transversely to said transport direction outwardly from said center, said orifices directing respective jets of air against said workpiece for unfolding said bent-over edge;

means for supplying air under pressure to said array of nozzles; and means connected with said nozzle for altering said flow direction, said means connected to said nozzle including at least one member connected in common to some of the nozzles of said array, said nozzles being plugs rotatable in a plate about respective axes perpendicular to said one of said surfaces, each of said orifices opening from said plug at a location diametrically opposite the location at which each plug is linked to said member.

4. An apparatus for flattening a sheet workpiece having an edge bent over on one face of said workpiece toward the center thereof and being continuously displaced in a transport direction generally parallel to the bent-over edge, said apparatus comprising:

a flat support surface lying against the other face of said workpiece at said bent-over edge;

a guide surface juxtaposed with and generally parallel to said support surface and spaced therefrom to overlie said one face of said workpiece;

a two dimensional array of orifices each formed in a respective nozzle in one of said surfaces, said orifices being inclined in a flow direction extending transversely to said transport direction outwardly from said center, said orifices directing respective jets of air against said workpiece for unfolding said bent-over edge;

means for supplying air under pressure to said array of nozzles; and means connected with said nozzle for altering said flow direction, said means connected to said nozzle including at least one member connected in common to some of the nozzles of said array, each of said surfaces being provided with a respective array of such nozzles and a respective such member controlling same.

5. An apparatus for flattening a sheet workpiece having an edge bent over on one face of said workpiece toward the center thereof and being continuously displaced in a transport direction generally parallel to the bent-over edge, said apparatus comprising:

a flat support surface lying against the other face of said workpiece at said bent-over edge;

a guide surface juxtaposed with and generally parallel to said support surface and spaced therefrom to overlie said one face of said workpiece;

a two-dimensional array of orifices each formed in a respective nozzle in one of said surfaces, said orifices being inclined in a flow direction extending transversely to said transport direction outwardly from said center, said orifices directing respective jets of air against said workpiece for unfolding said bent-over edge;

means for supplying air under pressure to said array of nozzles; and means connected with said nozzle for altering said flow direction, said means connected to said nozzle including at least one member connected in common to some of the nozzles of said array, a plurality of such arrays of nozzles with respective such members being juxtaposed with said workpiece, said apparatus further comprising means for controlling the airflow seclectively from said nozzles by said members to control the movement of said workpiece between said surfaces.

* * * * *